US012502595B2

(12) United States Patent
Goverud-Holm et al.

(10) Patent No.: US 12,502,595 B2
(45) Date of Patent: Dec. 23, 2025

(54) RELEASE MECHANISM FOR A SKI BINDING

(71) Applicant: ROTTEFELLA AS, Lierstranda (NO)

(72) Inventors: Thomas Goverud-Holm, Hof (NO); Magnus Anderssen, Nesodden (NO); Øyvar Svendsen, Oslo (NO); Jørn Frode Danielsen, Drøbak (NO); David Klovning Flem, Slependen (NO); Edward Jones, Lommedalen (NO)

(73) Assignee: ROTTEFELLA AS, Lierstranda (NO)

( * ) Notice: Subject to any disclaimer, the term of this patent is extended or adjusted under 35 U.S.C. 154(b) by 232 days.

(21) Appl. No.: 18/271,174

(22) PCT Filed: Jan. 7, 2022

(86) PCT No.: PCT/NO2022/050004

§ 371 (c)(1),
(2) Date: Jul. 6, 2023

(87) PCT Pub. No.: WO2022/149986

PCT Pub. Date: Jul. 14, 2022

(65) Prior Publication Data

US 2024/0050834 A1 Feb. 15, 2024

(30) Foreign Application Priority Data

Jan. 8, 2021 (NO) ..... 20210025

(51) Int. Cl.
*A63C 9/086* (2012.01)
*A63C 9/085* (2012.01)

(52) U.S. Cl.
CPC ..... *A63C 9/086* (2013.01); *A63C 9/08557* (2013.01)

(58) Field of Classification Search
CPC . A63C 9/08564; A63C 9/0846; A63C 9/0842; A63C 10/10; A63C 10/103;
(Continued)

(56) References Cited

U.S. PATENT DOCUMENTS 3,779,570 A * 12/1973 Betschart, Jr. ..... A63C 9/086 280/613
4,032,172 A 6/1977 Pyzel et al.
(Continued)

FOREIGN PATENT DOCUMENTS

DE 2511332 A * 9/1975
DE 102009059968 A1 * 6/2011 ..... A63C 9/0807
(Continued)

OTHER PUBLICATIONS

DE-102009059968-A1 English Translation (Year: 2011).*
(Continued)

*Primary Examiner* — Michael T. Walsh
(74) *Attorney, Agent, or Firm* — Harness, Dickey & Pierce, P.L.C.

(57) ABSTRACT

The present invention relates to a release mechanism for a ski binding system, wherein the system comprises a ski shoe wherein pins moveable in each direction are arranged and at least one intermediate spring element, wherein the pins are adapted to slide in a barrel between a protruding and a retracted position, The system comprises a frame with two vertical parts arranged on a ski, wherein each vertical part has an opening each for receiving a pin protruding sideways out of the ski shoe, two bails with claws at one end and brought together in a manipulator at the other end, wherein the claws and the manipulator are adapted so that they can move synchronously into the openings in the opposite direction of the pins.

8 Claims, 6 Drawing Sheets

Figure 1A:
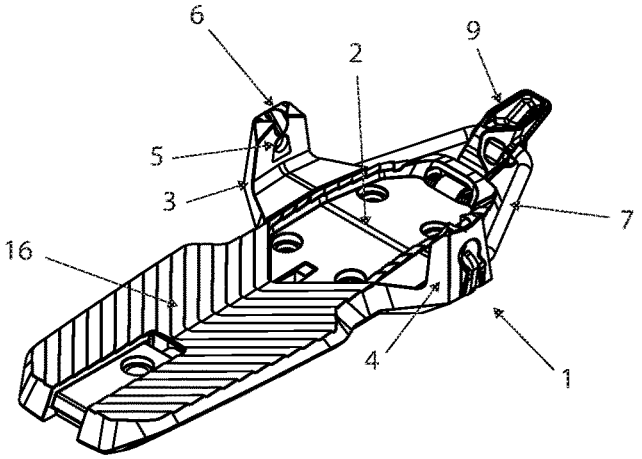
Figure 1B:
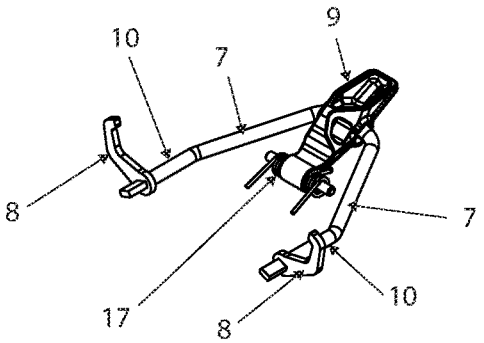
Figure 1C:
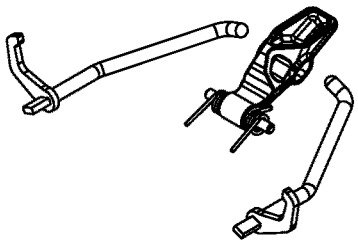
Figure 1D:
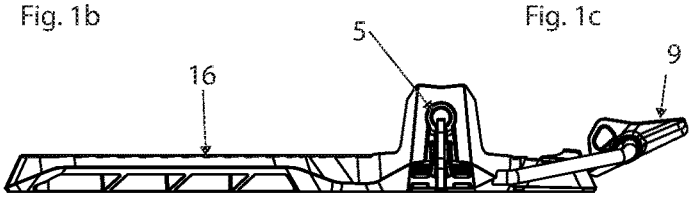
Figure 1E:
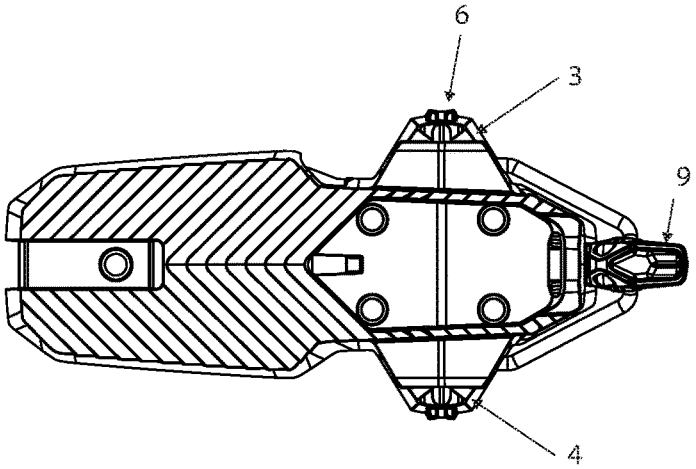

(58) Field of Classification Search
CPC . A63C 11/16; A63C 10/02; A63C 2017/0053; A63C 10/045; A63C 9/086; A63C 9/08557; A63C 9/0807; A63C 9/08571; A63C 9/08578; A63C 9/08585; A63C 9/08592
See application file for complete search history.

(56) References Cited

U.S. PATENT DOCUMENTS

| | | | | |
|---|---|---|---|---|
| 4,403,789 | A * | 9/1983 | Hickey | A43B 5/0417 280/636 |
| 5,697,631 | A * | 12/1997 | Ratzek | A63C 10/08 280/613 |
| 9,308,433 | B2 * | 4/2016 | Nobile | A63C 9/0805 |
| 9,526,973 | B2 | 12/2016 | Ibach et al. | |
| 9,873,033 | B2 * | 1/2018 | Debney | A43B 5/0482 |
| 2008/0116663 | A1 * | 5/2008 | Gyr | A63C 9/20 280/611 |
| 2018/0140932 | A1 | 5/2018 | Tremeau et al. | |
| 2024/0075376 | A1 * | 3/2024 | Goverud-Holm | A63C 9/20 |

FOREIGN PATENT DOCUMENTS

| | | | | |
|---|---|---|---|---|
| DE | 102015223117 | A1 | 5/2017 | |
| DE | 102018209090 | A1 | 12/2019 | |
| EP | 0680775 | A2 | 11/1995 | |
| EP | 2574379 | A2 | 4/2013 | |
| NO | 345664 | B1 * | 6/2021 | A63C 10/103 |
| WO | WO-8400498 | A1 | 2/1984 | |
| WO | WO-02087710 | A1 | 11/2002 | |

OTHER PUBLICATIONS

NO-345664-B1 English Translation (Year: 2021).*
DE-2511332-A English Translation (Year: 1975).*
International Search Report and Written Opinion issued in PCT/NO2022/050004, mailed Mar. 11, 2022; ISA/XN.
Norwegian Search Report issued in Norwegian Application No. 20210025, date of report: Aug. 7, 2021.
European Search Report for Application No. 22736953.5 dated Nov. 13, 2024.

* cited by examiner

SECTION D-D

DETAIL F

SECTION E-E

DETAIL G

RELEASE MECHANISM FOR A SKI BINDING

CROSS-REFERENCE TO RELATED APPLICATIONS

This application is a 371 U.S. National Phase of International Application No. PCT/NO2022/050004, filed Jan. 7, 2022, which claims priority to Norwegian patent application No. 20210025, filed Jan. 8, 2021. The entire disclosures of the above applications are incorporated herein by reference.

The present invention relates to a part of a binding system for skiing, more specifically a binding system for cross-country skiing, backcountry skiing or randonee as indicated in the preamble of claim 1.

BACKGROUND

U.S. Pat. No. 9,308,433B2 shows a binding system comprising a ski-mounted frame in the form of a U-shaped bracket, which is provided with openings adapted to receive moveable pins protruding from the tip of a ski boot. The moveable pins are arranged transversely on or in the ski boot and are biased by an intermediate spring that presses out the pins with a certain predetermined force. Said openings in the U-shaped bracket are provided with an axially travelling release mechanism in the form of moveable buttons, which the pins can fit into when the ski boot is attached to the ski.

The system is configured so that the buttons are to be compressed by the fingers, when the ski boot is to be released. When the buttons are compressed, the pins are simultaneously pushed into the ski boot, and the ski boot can thereby be released. This release mechanism requires that the user bends down to the bindings, manages to position the hands correctly relative to the buttons and has sufficient coordination and force in the fingers to compress the buttons—and hence the pins—under all conditions to be expected during skiing.

If the snow is deep, the terrain is difficult or the fingers are cold, it can be challenging to press in the buttons in a sufficiently coordinated manner. Some users may also have challenges with the mobility of their body, hands or fingers, e.g. due to age, injury, or exhaustion.

Therefore, there is a need for a release system which is easier to operate in a standing position, by means of the pole and/or without being dependent of good mobility and strength in hands and fingers.

At least one of these and optionally also other objects can be achieved by means of a device as indicated in the characterizing part of claim 1. Additional advantageous and/or alternative embodiments are disclosed in the dependent claims.

BRIEF COMMENTS ON THE DRAWINGS

Figure 2A:
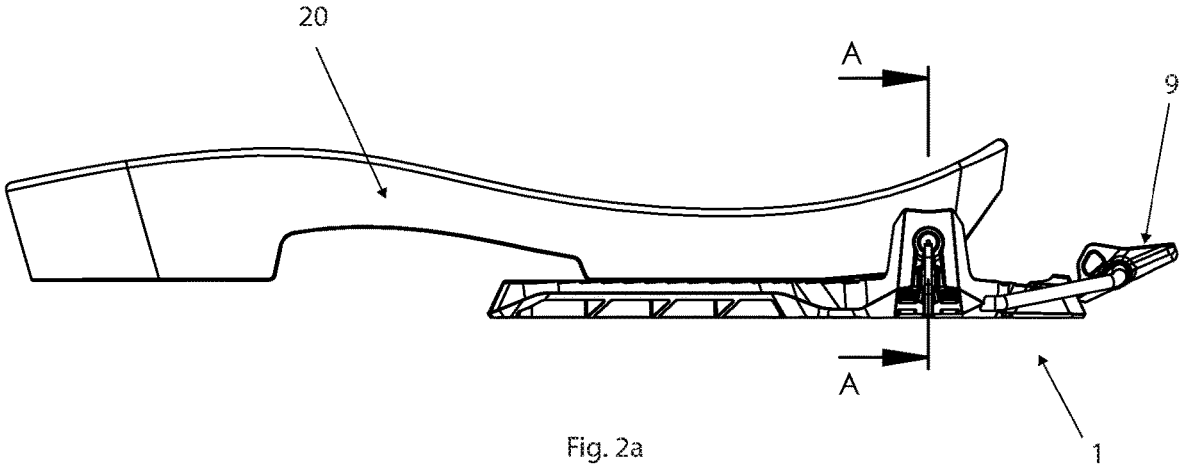
Figure 2B:
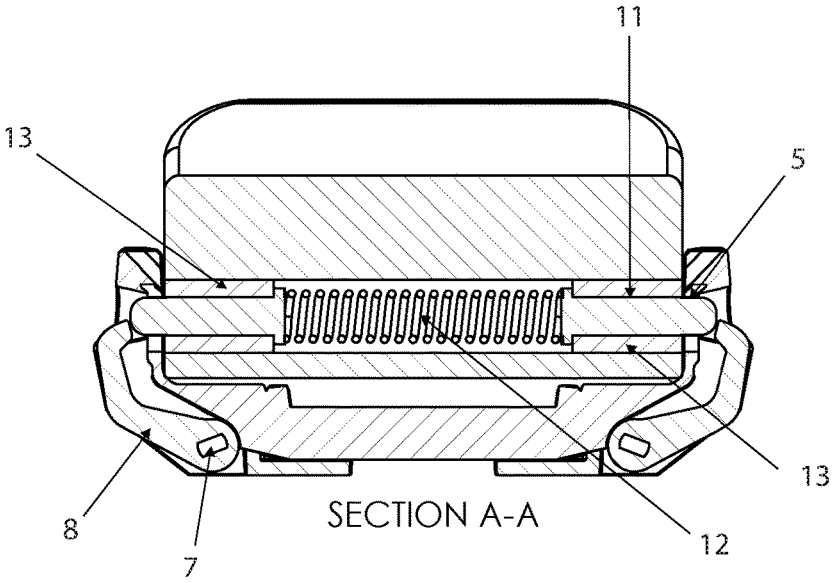
Figure 3A:
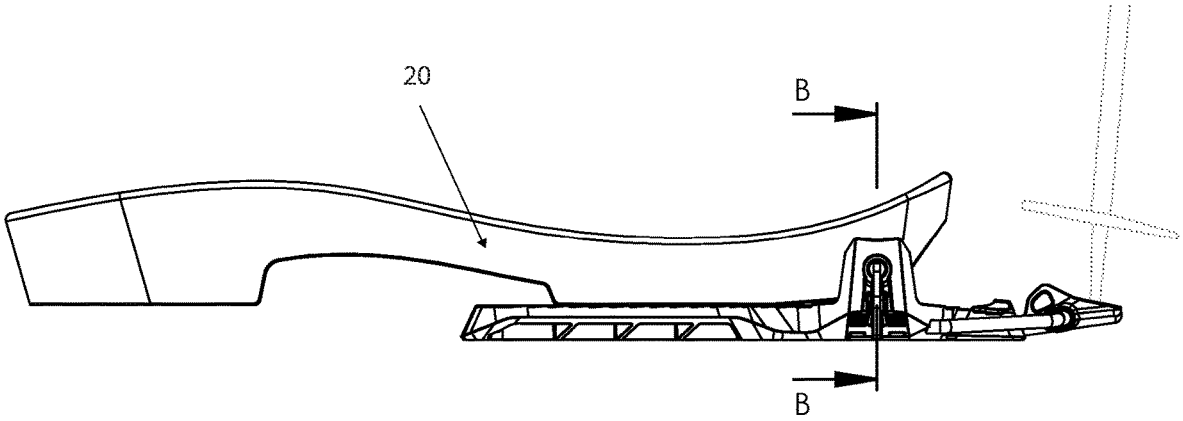
Figure 3B:
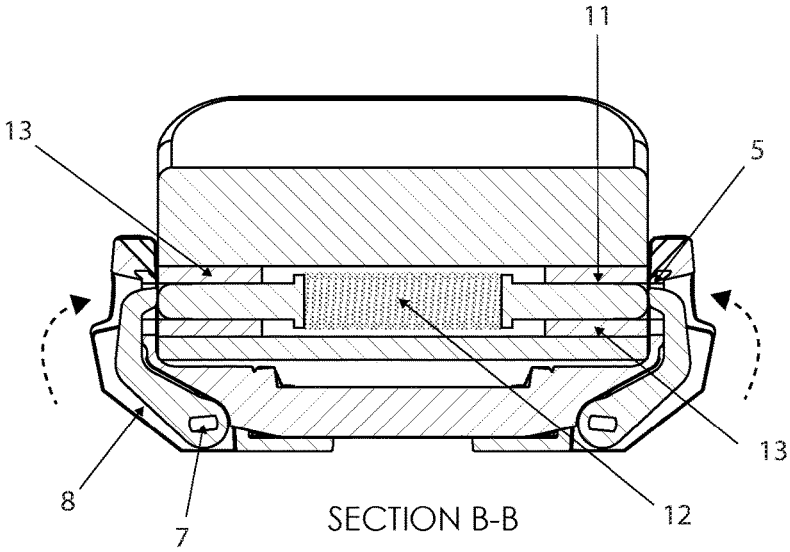
Figure 4A:
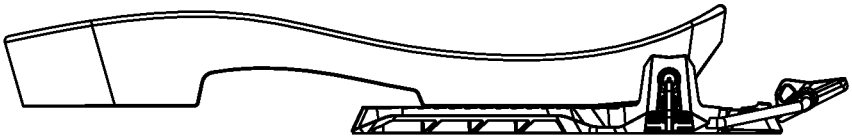
Figure 4B:
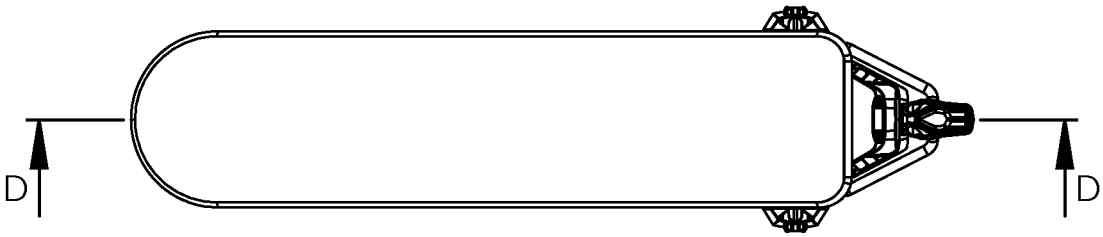
Figure 4C:
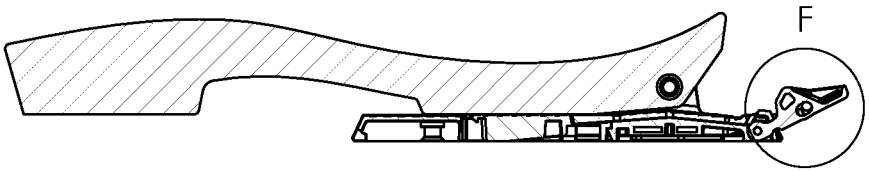
Figure 4D:
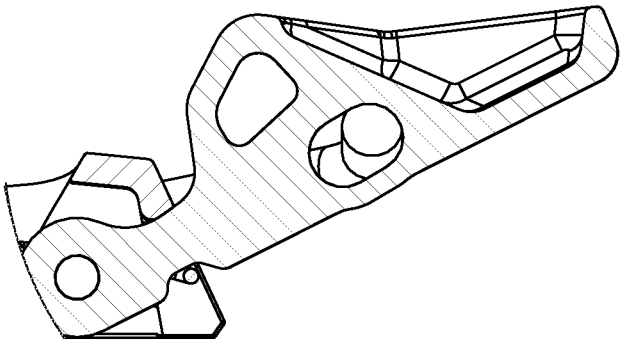
Figure 5A:
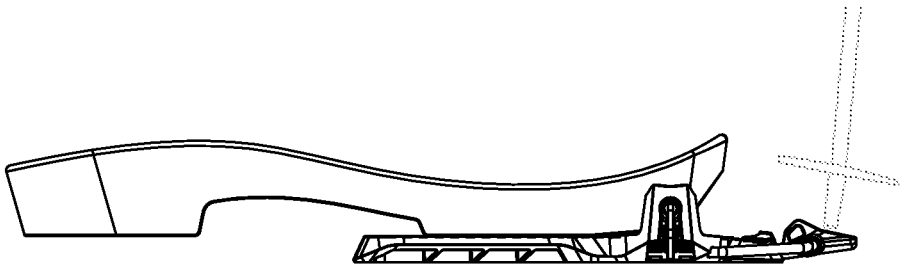
Figure 5B:
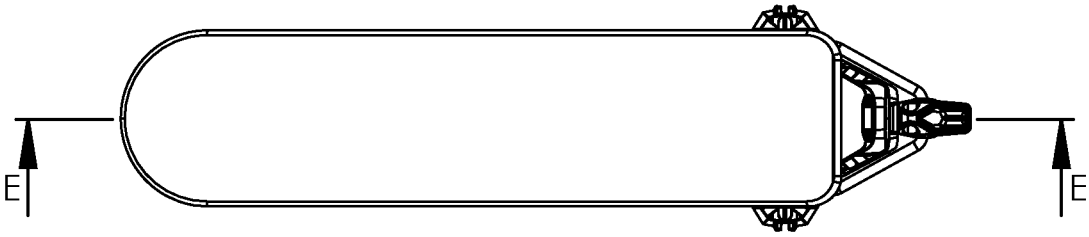
Figure 5C:
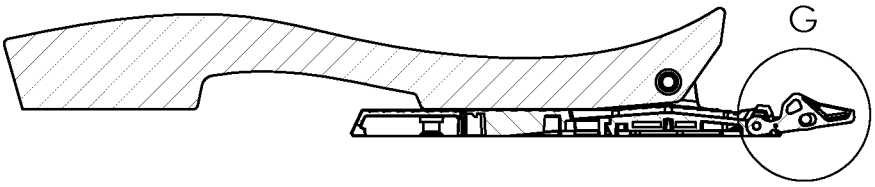
Figure 5D:
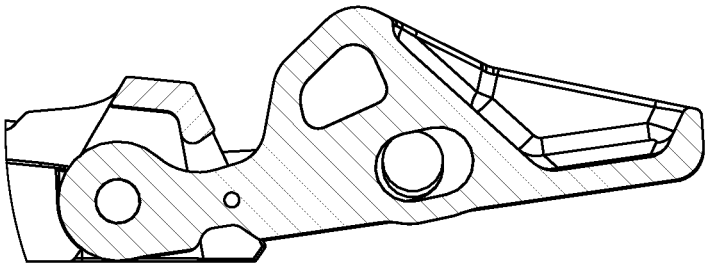
Figure 6:
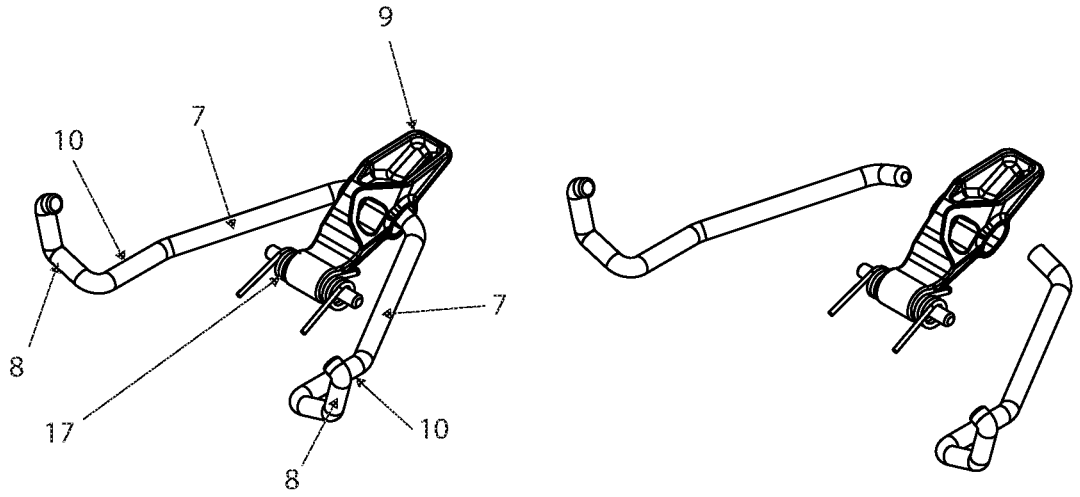
Figure 7:
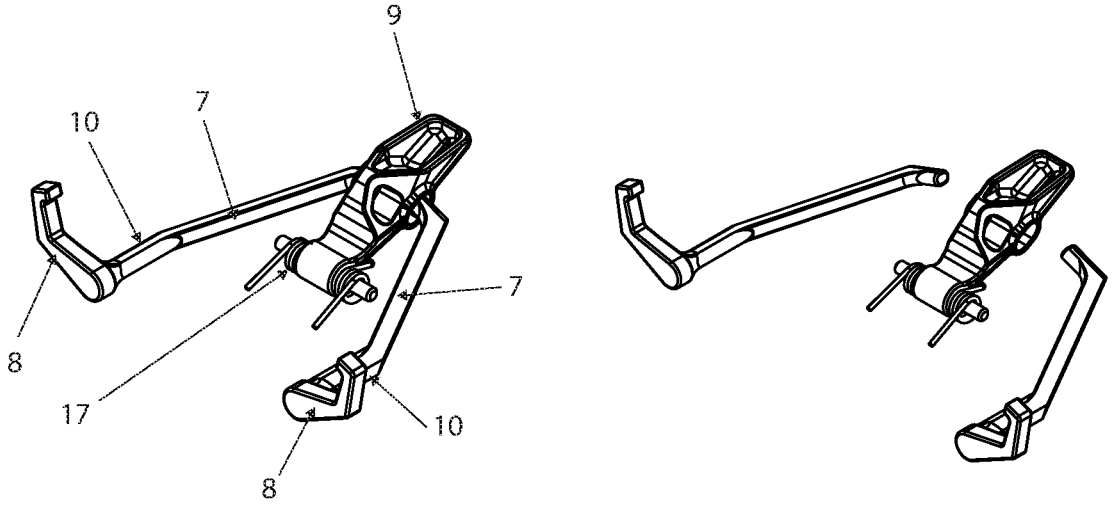

The above-mentioned objects as well as further objects, characteristics and advantages of the present invention, will also to a larger extent be understood by means of the following illustrative and non-limiting description and with reference to the accompanying figures of a possible embodiment of the invention, wherein:

FIGS. 1*a-e* show a possible embodiment of the system according to the invention in perspective, partially expanded, from the side and from above, respectively, FIGS. 2*a-b* show the embodiment from the side and along the section A-A while the ski shoe is fixed in the binding, FIGS. 3*a-b* show the embodiment from the side and along the section B-B, while the ski shoe is being synchronously released from the binding, FIG. 4*a* corresponds to FIG. 2*a*, FIG. 4*c* shows section D-D from FIG. 4*b*, and FIG. 4*d* shows the detail F from FIG. 4*d*, FIGS. 5*a-d* correspond to FIGS. 4*a-d*, but now in the released state, FIG. 5*c* showing section E-E from FIG. 5*b*, and FIG. 5*d* shows the detail FIG. 5*d*, FIG. 6 shows an alternative embodiment of the bails and claws, and FIG. 7 shows yet another embodiment of the bails and claws.

DETAILED DESCRIPTION

FIGS. 1*a-e*, FIGS. 2*a-b* and FIGS. 3*a-b* show a first embodiment of the present invention. A binding 1 comprises a U-shaped bracket 2 with two upwardly protruding, vertical parts 3, 4 adapted to receive transverse, protruding, moveable pins 11 projecting from a ski shoe 20. The pins 11 fit into holes 5 in the bracket 2. The bracket 2 can comprise tracks 6 configured as sloping ramps that receive, guide and press the pins 11 into the openings 5.

Though the frame 2 is shown as a U-shaped bracket, wherein the vertical parts 3, 4 are attached to a horizontal part 16, other configurations are also imaginable, e.g. a bracket that visually looks like a 75 mm toe iron, a II-, H- or Y-shaped solution etc.

The solution comprises two bails 7 each of which is provided with claws 8 at one end. At the other end, the bails 7 are configured, so that they come together in a manipulator or rocker arm 9, while simultaneously having an essentially longitudinal segment 10, which is secured in suitable, longitudinal tracks in the binding 1. When the rocker arm 9 is pressed down, as shown in 3*a* and *b*, the bails 7 are rotated about the longitudinal segments 10, causing the claws 8 to rotate synchronously towards each other. The claws 8 are configured so that the rotate into the openings 5 from the outside. The bails 7, or part of the bails 8, e.g. the longitudinal segments 10 as shown in the figures, are adapted so that they are rotated about their longitudinal axes.

The rocker arm 9 can be replaced by another form of manipulator, e.g. a pushbutton, toggle switch, and hook. Manipulator means something that can be operated with the hands, but it is understood that this can also take place via a pole, by stepping on the manipulator etc. In FIGS. 1 *b* and *c*, a bias spring 17 can be seen vaguely, which biases the manipulator, and thereby also the bails 7 and the claws 8, in a predetermined position. In this case, the bails 7 and the claws 8 are biased outwardly, so that the ski shoe 20 can be stepped into the binding 1 without any kind of resistance. The function of the bias spring 17 in the shown embodiment is primarily to avoid slack and sounds, so as to offer a good user experience.

FIGS. 2*a-b* show, from the side and along section A-A, respectively, how the pins 11 project into the holes 5 when the ski shoe is attached to the binding 1. The claws 8 can touch the end of the pins 11, but with no or insignificant force.

FIGS. 3*a-b* show, from the side and along section B-B, respectively, how the claws 8 compress the pin 11 synchronously when the rocker arm 9 is pressed down, e.g. by manual power or by means of a pole tip. This causes the pins 11 to be compressed synchronously and out of the holes 5, so that the shoe can be released from the binding 1.

The configuration of the pins 11 and the openings 5, with small tolerances and right angles as well as the minimal tolerances laterally, when the shoe is located in the space between the two upwardly protruding, vertical parts 3, 4 of the U bracket 2, means that shoe is not easily, if at all, released if the pins 11 are not synchronously compressed by the release mechanism. If only one pin 11 is pressed sufficiently far into the shoe, the geometry of the pins 11 and the openings 5 will cause the shoe to get stuck in the binding 1. As there is a risk that it will not be possible to twist the shoe out of the U bracket, it is essential that the rotation of the bails, and hence the claws 8, is synchronous, so it is ensured that both pins 11 are pressed sufficiently strongly together when the user wishes to release the ski shoe 10 from the ski (not shown) by pressing down the rocker arm 9. It is understood that a manipulator 9 and the bails 7 can also be configured, so that the synchronous compression of the claws 8 takes place when the manipulator 9 is pulled up, twisted, released or through another movement. It is also understood that the manipulator 9 can consist of several connected or interacting parts.

According to the present invention, the configuration and rotation of the bails 7 and the claws 8 must be such that when the rocker arm 9 is pressed down (or optionally up), a synchronous compression of the pins 11 arises. The rotation of the claws 8 into the openings 5 must give an axial component of force sufficient to compress the pins 11 synchronously and predictably. In addition, the bails 7 and the claws 8 could have components of force that progress in other planes that the axial plane through the openings 5, depending on the hinging of the bails 7 in the binding and possibly the configuration of the claws 8. Various alternative configurations could give variations of the sizes and directions of the components of force, but, as mentioned, what is most important is that the rotation of the claws 8 into the openings 5 must give an axial component of force sufficient to compress the pins 11 synchronously and predictably.

FIGS. 4*a-d* and FIGS. 5*a-d* more specifically show the binding system in interconnected and released states, respectively. Details 4*d* and 5*d* show how the ends of the bails 7 slide back and forth in holes in the rocker arm 9 when it is pressed down.

FIGS. 6 and 7 show alternative embodiments of the claws 8. These can consist of own parts of various configurations or be constituted by a curved end of the bails 7.

The invention claimed is:

1. A release mechanism for a ski binding system, wherein the mechanism comprises:

a ski shoe wherein pins, one moveable in each direction, and at least one intermediate spring element are arranged, wherein the pins are adapted to slide in a barrel between a protruding and a retracted position, a frame with two vertical parts arranged on a ski, wherein each vertical part has an opening each for receiving a pin protruding sideways out of the ski shoe, two bails, each with one claw at one end and brought together in a manipulator at the other end, wherein the claws and the manipulator are adapted so that they can move synchronously into the openings in the opposite direction of the pins.

2. A release mechanism according to claim 1, wherein the manipulator is selected among the group comprising: rocker arm, pushbutton, toggle switch, and hook.

3. A release mechanism according to claim 1, wherein the frame constitutes a U-shaped bracket, wherein the vertical parts are attached to a horizontal part.

4. A release mechanism according to claim 1, wherein the vertical parts comprise tracks, which are configured as sloping ramps receiving, guiding and pressing the pins into the openings when the ski shoe is placed in the tracks.

5. A release mechanism according to claim 1, wherein each of the bails has an essentially longitudinal segment fixed in suitable, longitudinal tracks or channels in the binding, and wherein the bails and the manipulator are arranged in front of the frame.

6. A release mechanism according to claim 1, wherein the claws are adapted to move synchronously into the openings, when the bails are rotated about their longitudinal axes via the manipulator.

7. A release mechanism according to claim 1, wherein the manipulator is spring-biased.

8. A release mechanism according to claim 1, wherein the claws are formed by own parts or the bails in themselves.

* * * * *